United States Patent [19]

Kigawa et al.

[11] 4,121,914

[45] Oct. 24, 1978

[54] PIPING SYSTEMS FOR DRAINAGE AND PIPING MEMBERS THEREFOR

[75] Inventors: Tomio Kigawa, Matsubara; Takeshi Ishihara, Kawachi-Nagane, both of Japan

[73] Assignee: Kubota, Ltd., Osaka, Japan

[21] Appl. No.: 771,255

[22] Filed: Feb. 23, 1977

[30] Foreign Application Priority Data

| | | | |
|---|---|---|---|
| Feb. 25, 1976 | [JP] | Japan | 51-20393 |
| Aug. 18, 1976 | [JP] | Japan | 51-99172 |
| Aug. 31, 1976 | [JP] | Japan | 51-104763 |

[51] Int. Cl.[2] ..... B01D 19/00

[52] U.S. Cl. ..... 55/191; 4/211; 55/199; 137/561 A

[58] Field of Search ..... 4/211, 216, 219; 55/52, 55/191, 199, 203, 204; 137/561 A; 138/178; 210/163; 285/150, 154

[56] References Cited

U.S. PATENT DOCUMENTS

| | | | |
|---|---|---|---|
| 1,186,280 | 6/1916 | Carson | 4/211 X |
| 1,459,585 | 6/1923 | Felton | 285/150 X |
| 2,499,900 | 3/1950 | Bouldin | 4/211 X |
| 3,968,815 | 7/1976 | Legg et al. | 4/211 X |

*Primary Examiner*—Charles N. Hart
*Assistant Examiner*—Richard W. Burks
*Attorney, Agent, or Firm*—Joseph W. Farley

[57] ABSTRACT

A drainage piping system for discharging soil water and waste water from various plumbing fixtures comprises a vertical main pipe and lateral branch pipes connected to the fixtures. To provide a single-pipe confluence system for installation in medium-sized or high buildings without employing a vent pipe to be arranged along the vertical main pipe, the main pipe incorporates at least one twisted pipe portion having an axis helically deviating from the axis of the main pipe.

7 Claims, 24 Drawing Figures

PIPING SYSTEMS FOR DRAINAGE AND PIPING MEMBERS THEREFOR

The present invention relates to piping systems for drainage and piping members therefor.

Drainage piping systems for discharging soil water and waste water generally comprise lateral branch pipes connected to various sanitary and cooking installations for carrying soil water and waste water from toilets, sinks, etc., a vertical main pipe connected to the lateral branch pipes, and Y branches, tees or like branch fittings for interconnecting the main pipe and the branch pipes. In view of drainage capacity, prevention of odor and ventilation, multistory buildings are equipped with a three-pipe system wherein the vertical main pipe is divided into a soil pipe and a waste pipe which are installed conjointly with a vent pipe, or with a two-pipe confluence system in which a vertical main pipe for both soil water and waste water is provided with a vent pipe. Particularly with medium-sized and tall buildings, however, the conventional drainage systems, although incorporating the vent pipe, involve the problem that when the vertical main pipe is heavily loaded, water seals provided for various fixtures can not always withstand the resulting pressure variation, possibly failing to afford the desired sealing effect. Furthermore, conventional systems entail another problem that the descending drain will produce a disturbing noise particularly on the lowermost floor.

It is therefore proposed to attach blades to the inner wall of the vertical main pipe to give a swirling force to the descending fluid. The blades are adapted to positively impart a centrifugal force to the descending drain, causing the drain to flow down the inner wall of the pipe helically in the form of a layer at a reduced vertical velocity and thereby forming a column-shaped ventilating air layer within the pipe centrally of its cross section. Where the blades are installed, however, the blades reduce the interior space of the pipe in cross section, with the result that solid wastes contained in the drain are liable to lodge on the blades and block up the pipe. Thus, the proposed system is not fully satisfactory. In particular, many problems still remain to be solved in providing a single-pipe confluence system in which the column-spaced air layer is fully serviceable in place of the vent pipe.

The main object of this invention is to eliminate the drawbacks inherent in the use of the blades and to provide a drainage piping system which includes a twisted pipe portion substituting for the blades and having an axis helically deviating from the axis of a vertical main pipe. The twisted pipe portion, unlike the blades, does not involve any cross sectional reduction in the interior space of the vertical main pipe, permitting the drain to flow through the main pipe in the form of a helically swirling descending stream. This not only gives the descending drain a reduced velocity in the vertical direction but also causes the drain to flow down the inner surface of the pipe as if adhering thereto due to the attendant centrifugal force. This mode of the drain flow and the absence of the reduced space portion ensure that the vertical main pipe will have an air column extending therethrough in the center of its cross section and communicating with the atmosphere. The air column eliminates variations in the internal pressure of the main pipe which otherwise would adversely affect the function of the water seals provided for the sanitary and cooking fixtures. A single-pipe confluence system is therefore available without the necessity of employing a conventional vent pipe. The noise resulting from the downward flow of the drain is also reducible, because the drain flows along the inner surface of the pipe in the form of a layer at a reduced vertical velocity.

Another object of this invention is to provide a drainage piping system in which the twisted pipe portion is provided immediately below a branch fitting interconnecting a vertical main pipe and lateral branch pipes connected to sanitary and cooking fixtures, such that the drain flowing into the main pipe from the lateral branch pipe is forcibly swirled on entrance into the main pipe. Consequently, the inflow of the drain into the main pipe will produce no turbulence in the swirling flow of the drain descending through the main pipe. The twisted pipe portion may be formed integrally with the branch fitting, or alternatively, a twisted connector pipe having a twisted pipe portion may be joined to the branch fitting.

Another pipe of this invention is to provide a drainage piping system in which the twisted pipe portion is provided at an intermediate portion of a vertical main pipe between branch fittings, such that the twisted pipe portion can be disposed at a position other than where the vertical main pipe extends through each floor. Accordingly, the bore for passing the main pipe through the floor can be of reduced size, the piping system is easy to install and the bored portion is easy to close and finish up, because the straight main pipe passes through the bore.

Another object of this invention is to provide a drainage piping system in which the twisted pipe portion is provided immediately above the connection between the lowermost end of a vertical main pipe and a horizontal main drain pipe. Generally, a 90° bend is used at the connection betweeen the vertical main pipe and the horizontal main pipe. The bend involves the following problem. When the vertical main pipe is heavily loaded, the drain flowing down the inner peripheral surface of the vertical main pipe in an annular form, due to an abrupt directional change within the pipe, cascades across and blocks the air column within the pipe, entailing a splash on injection into the horizontal main pipe. Consequently, the air having positive pressure and induced into the vertical main pipe by the descending drain is unable to smoothly flow into the horizontal main pipe, giving rise to an abnormal increase in the pressure at the bottom of the vertical main pipe and thereby producing an adverse effect on the traps for the sanitary and cooking fixtures on the lower floors. Furthermore, in the case where the lather of detergent remains in the horizontal main pipe, the drain flow, even in a small amount, tends to increase the positive pressure. A reverse vent pipe, even when installed, would prove totally ineffective in precluding such phenomenon. With the drainage piping system to be provided by this invention, the drain is caused to swirl upstream of the 90° bend connection, whereby the air column formed within the vertical main pipe centrally thereof is allowed to gradually flow into an upper portion of the horizontal main pipe without being blocked at the bend portion. This makes it possible to prevent an excessive rise in the positive pressure without employing a reverse vent pipe. Moreover the reduction in the falling velocity of the drain achieved by the twisted pipe portion prevents the splash at the inlet of the horizontal main pipe, thus also ensuring the prevention of the excessive positive pressure. The twisted pipe portion may be formed integrally with the bend at the connection, or alternatively, a twisted connector pipe may be joined to the bend.

Still another object of this invention is to provide piping members having a twisted pipe portion. The piping members include those formed at the opposite ends with joint portions for the vertical main pipe, with or without a connecting branch for a lateral branch pipe, those in the form of a bend having a twisted pipe portion, and various other modifications.

The foregoing and other features and advantages of this invention will become apparent from the following description of embodiments of the invention given with reference to the accompanying drawings, wherein.

Figure 1:
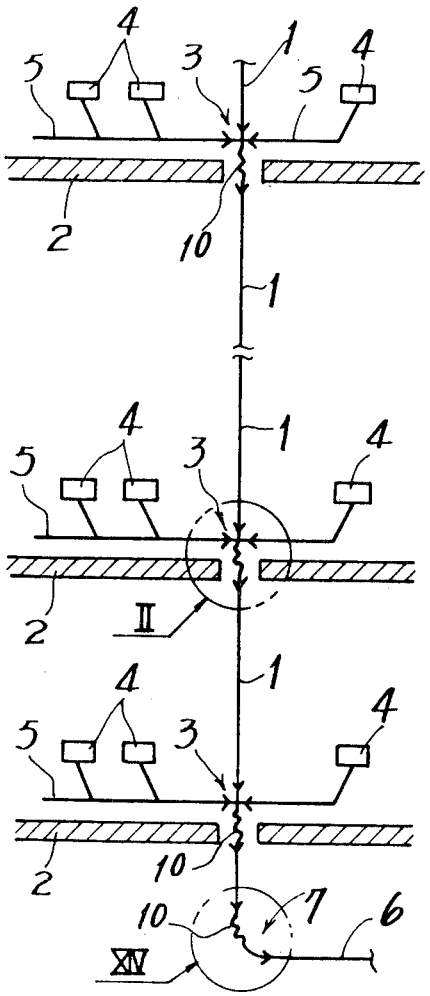
FIG. 1 is a diagram showing a drainage piping system embodying the invention.
Figure 10:
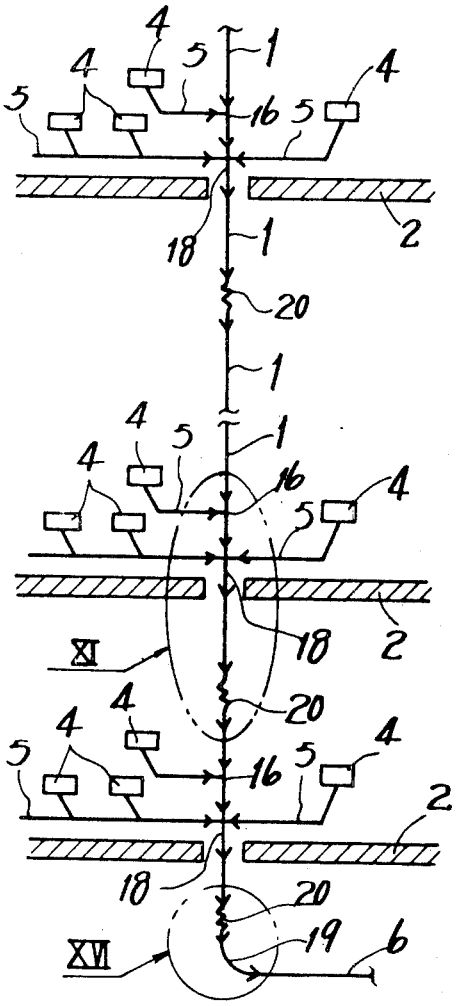
Figure 2:
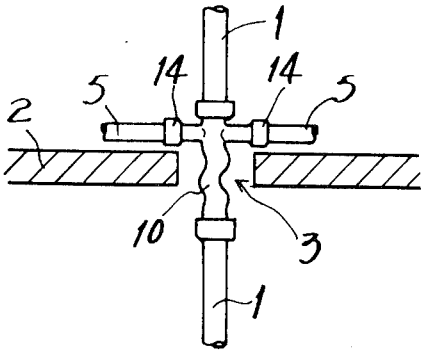
FIG. 2 is a front view of the portion indicated by the arrow II in FIG. 1.
Figure 8:
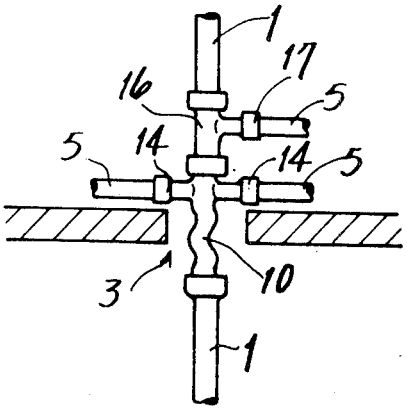
Figure 3:
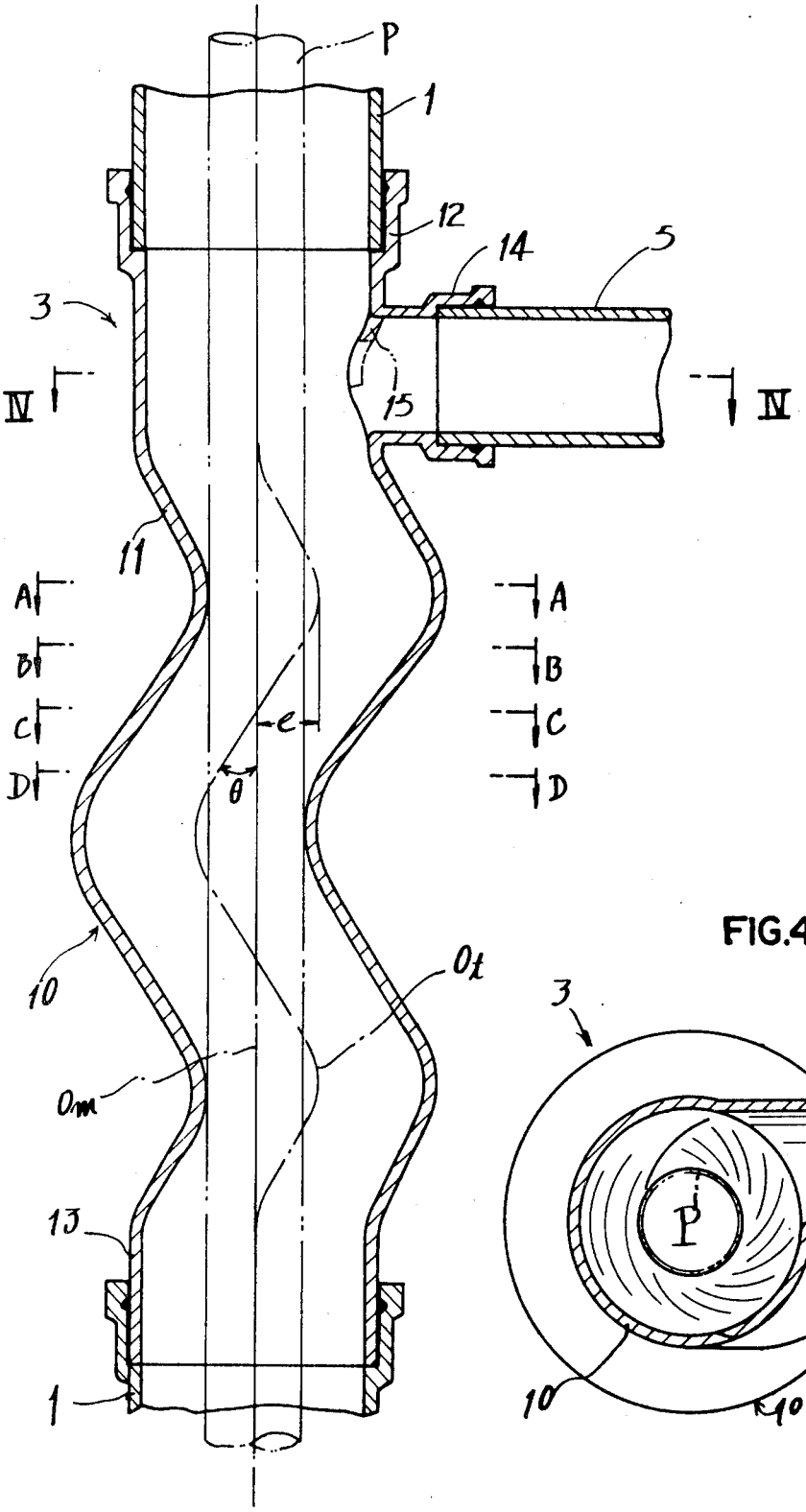
FIG. 3 is an enlarged front view in vertical section showing the principal part of the system.
Figure 5:
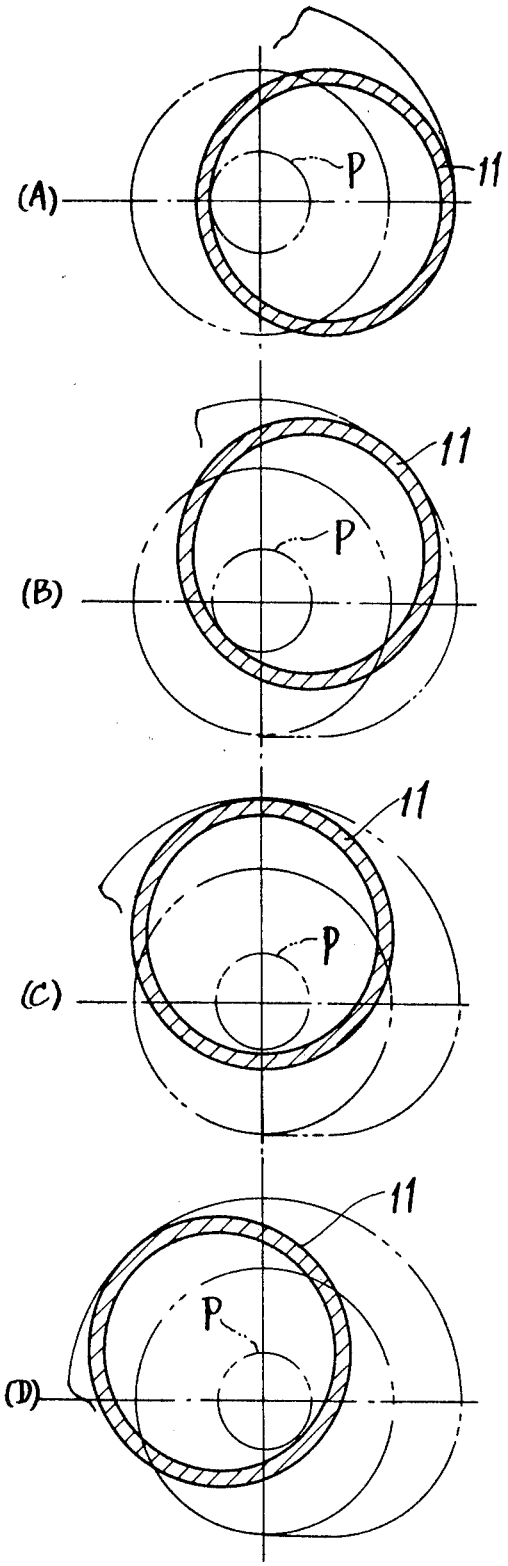
Figure 6:
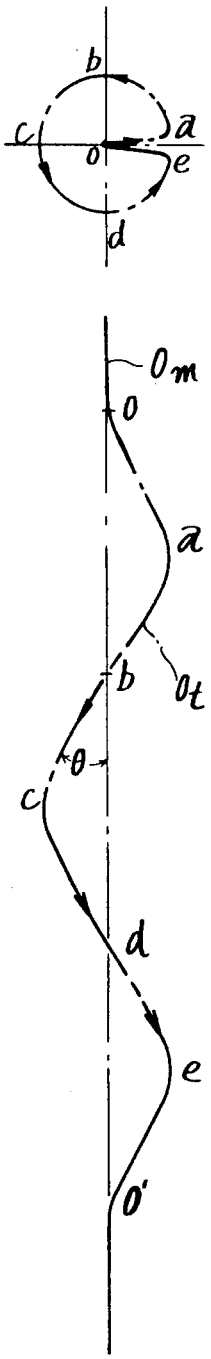
Figure 7:
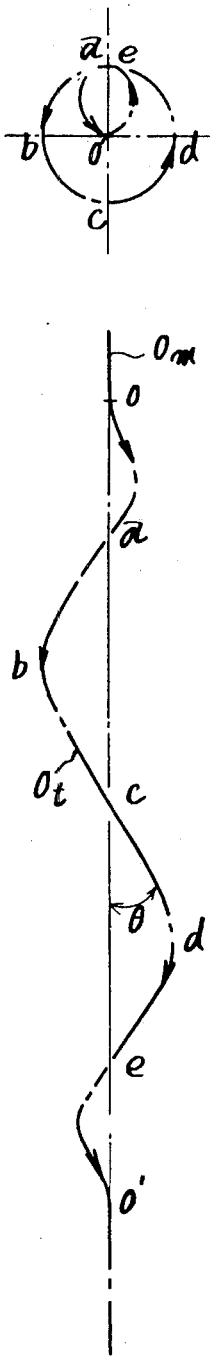
Figure 9:
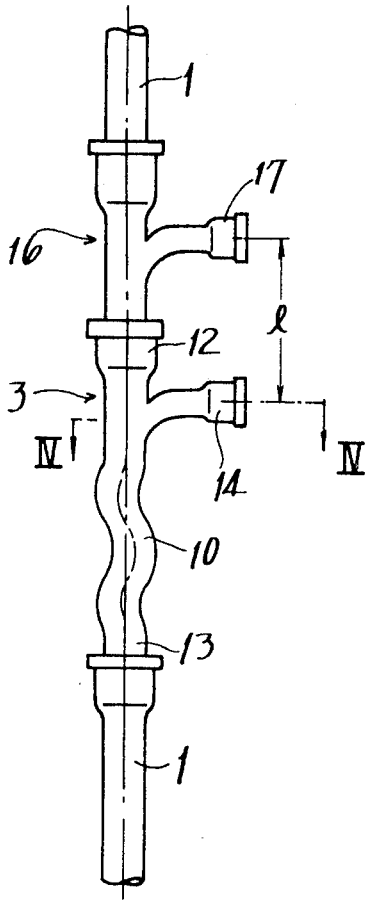
Figure 11:
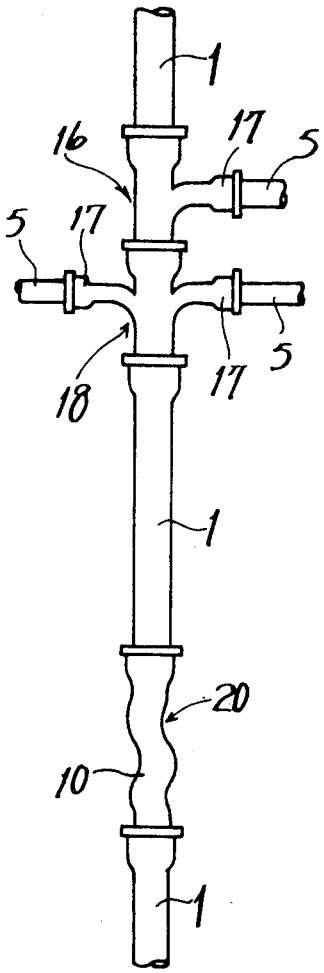
Figure 12A:
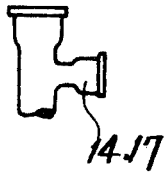
Figure 12B:
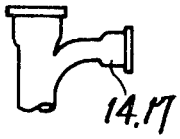
Figure 12C:
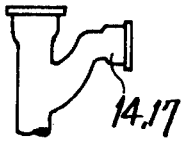
Figure 12D:
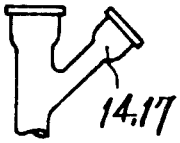
Figure 13A:
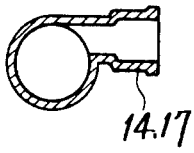
Figure 13C:
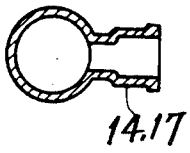
Figure 13E:
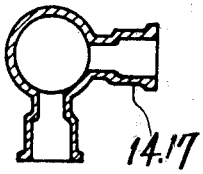
Figure 13B:
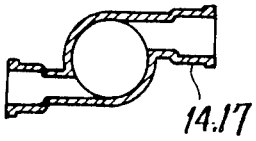
Figure 13D:
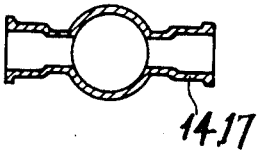
Figure 14:
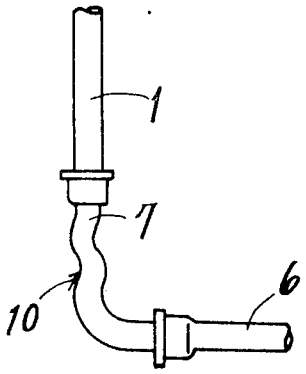
Figure 15:
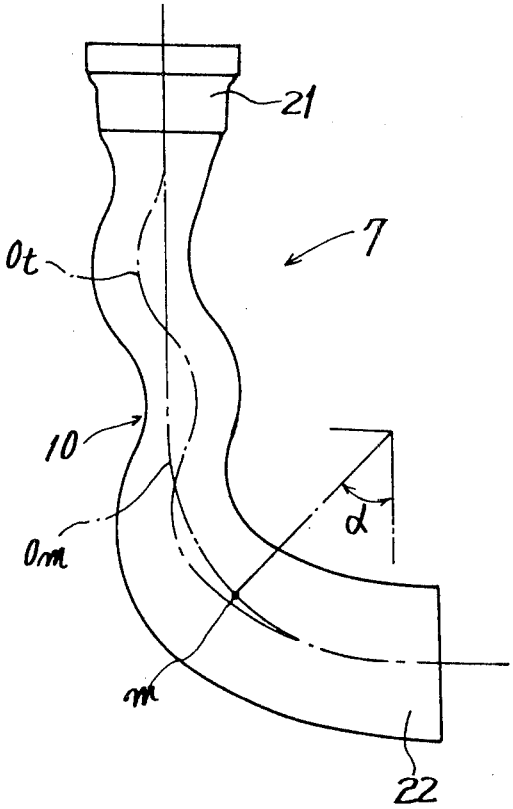
Figure 16:
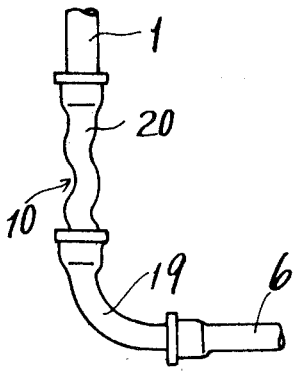
Figure 17:
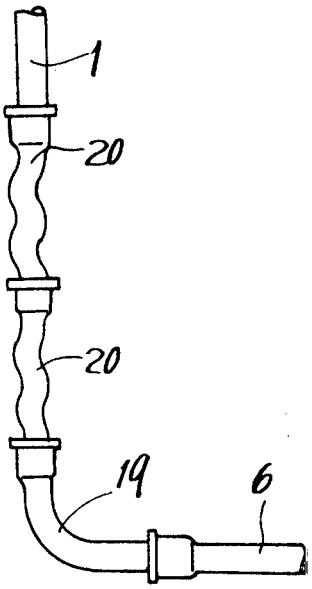

FIG. 5 includes views in cross section taken at the positions A to D shown in FIG. 3;

FIG. 6 is a diagram showing the axis of a twisted pipe portion to illustrate the twist of the portion;

FIG. 7 is a similar view illustrating the twist of a modification of the twisted pipe portion;

FIG. 8 is a view similar to FIG. 2 and showing a modified arrangement of branch fittings;

FIG. 9 is an enlarged view of the arrangement of FIG. 8;

FIG. 10 is a diagram showing another embodiment of the drainage piping system;

FIG. 11 is an enlarged front view showing the portion indicated by the arrow XI in FIG. 10;

FIGS. 12*a* to 12*d* are front views showing various examples of branch portions for connecting a lateral branch pipe;

FIGS. 13*a* to 13*e* are plan views in cross section showing various examples of branch portions having branches oriented in varying directions for lateral branch pipes;

FIG. 14 is a front view of the portion indicated by the arrow XIV in FIG. 1;

FIG. 15 is an enlarged front view of the bend shown in FIG. 14;

FIG. 16 is a front view of the portion indicated by the arrow XVI in FIG. 10; and FIG. 17 is a front view showing a modification of the portion shown in FIG. 16.

FIG. 1 shows a single-pipe confluence system adapted for installation in a medium-sized or multistory building and embodying the present invention. A main pipe 1 extending vertically includes pipe segments the opposed upper and lower ends of which are interconnected by branch fittings 3 at the positions of floors 2. Thus, the vertical main pipe 1 extends straight vertically through the floors 2. Lateral branch pipes 5 are connected, each at one end, to sanitary and cooking fixtures 4 such as washbowls, toilets, bathtubs and sinks. Each of the lateral branch pipes 5 communicates with the vertical main pipe 1 via a connecting portion formed in an upper portion of the barnch fitting 3. A horizontal main pipe 6 is connected by a bend 7 to the lowermost end of the vertical main pipe 1. With the present embodiment, the branch fitting 3 is integrally formed in its lower portion with a twisted pipe portion 10 as shown in FIG. 2. The bend 7 is also integrally formed with a twisted pipe portion 10 in its upper half portion as seen in FIG. 14.

Figure 4:
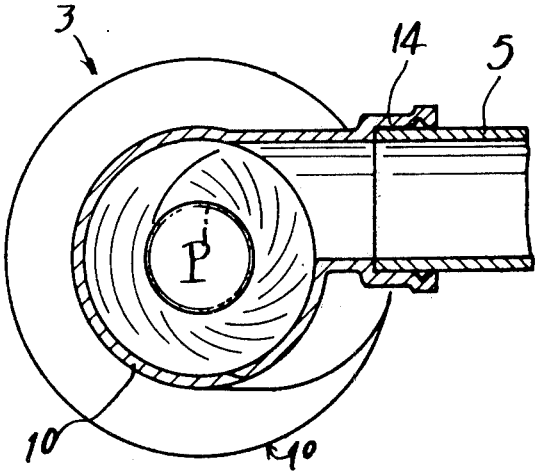
FIG. 4 is a plan view in cross section taken along the line IV—IV in FIGS. 3 and 9.

The branch fitting 3 having the twisted pipe portion 10 will be described below in greater detail with reference to FIGS. 3 to 6. The branch fitting 3 shown in FIG. 3 comprises a pipe body 11 provided with an upper socket end 12 and a lower insert end 13 to be joined to the vertical main pipe. The branch portion below the socket end 12 of the pipe body 11 has one or a plurality of laterally projecting branches 14 for connecting the lateral branch pipes. The branch fitting illustrated has one branch 14. In the present embodiment, the branch 14 extends from the pipe body 11 tangentially of its peripheral wall as seen in FIG. 4. Alternatively, the branch 14 may extend from the pipe body 11 radially thereof. Between the branch portion and the insert end 13, the pipe body 11 is so twisted that its axis O*t* helically deviates from the axis O*m* of the vertical main pipe 1 to provide the twisted pipe portion 10. The axis O*t* of the twisted pipe portion 10 is twisted downwardly counterclockwise, because in the northern hemisphere, fluids in the natural condition swirl downwardly counterclockwise and the twisted pipe portion will form a swirling flow with greater ease when twisted in the same direction as above. In the southern hemisphere the reverse direction is preferable. However, since the flow can be swirled in the opposite direction, the above-mentioned twisting direction is not limitative. The amount of the deviation *e*, of the axis O*t* of the twisted pipe portion 10 from the axis O*m* of the vertical main pipe is preferably one-tenth to one-fifth of the inside diameter of the pipe body 11. The angle of inclination, $\theta$, of the inner surface of the twisted pipe portion 10 is preferably in the range of 10° to 45° with respect to a vertical plane.

The operation of the foregoing system will be described. The drain from an upper floor flows down the inner surface of the vertical main pipe 1 in a laminar flow or stream and enters the socket end 12 and further flows into the pipe body 11. In the twisted pipe portion 10, the drain flows along the direction of the twist of the pipe body 11 while being helically swirled downwardly counterclockwise in the manner of (A)→(B)→(C)→(D) illustrated in FIG. 5 and reaches the insert end 13. Consequently, the drain from the insert end 13 quietly flows down the inner surface of the vertical main pipe 1 in the form of a layer while helically swirling. Since the drain flows down the inner surface of the pipe as if adhering thereto, the air contained in the drain is separated, forming a continuous air column P vertically extending through the center of the main pipe 1 and communicating with the atmosphere at the uppermost end of the main pipe 1. The air column P eliminates variations in the internal pressure within the vertical main pipe 1 which would produce an adverse effect on the water seals for the fixtures 4.

The drain flowing from the lateral branch pipe 5 into the pipe body 11 by way of the branch 14 swirls along the inner surface of the pipe body 11, joining the drain flowing downward through the vertical main pipe 1. The combined flow descends in the same manner as above while swirling helically. If the branch 14 extends in the tangential direction as seen in FIG. 3, the drain from the lateral branch pipe 5 will flow along the inner surface of the pipe body 11, with the result that the drain has a reduced velocity in the vertical direction and smoothly joins the drain from upper floors to flow downward. Accordingly, the branch portion will not permit the drain to block the air column P while also enhancing the effect to be achieved by the twisted pipe portion 10.

As shown in phantom line in FIG. 3, the pipe body 11 may be provided with a downward projection 15 at the junction between the pipe body 11 and the branch 14. The projection 15 is formed along the upper half of the periphery of the junction and has an inner surface continuous with the inner surface of the pipe body 11. The projection is inclined slightly inward. The drain flowing from above through the vertical main pipe 1 into the pipe body 11 can be prevented by the projection 15 from flowing into the lateral branch pipe 5.

FIGS. 6 and 7 are diagrams showing the relation between the axis O*t* of the twisted pipe portion 10 of the pipe body 11 and the axis O*m* of the vertical main pipe 1. The straight axis O*m* extends into the helical axis O*t* in such a manner that as seen in FIG. 6 corresponding to the embodiment of FIG. 3, the axis obliquely extends from point O to point *a* until a specified amount of deviation is achieved and thereafter helically extends as *a*→*b*→*c*→*d*→*e* with a constant amount of deviation. From the point *e* the axis extends slantingly to a point O′ on the axis O*m*. Alternatively, from point O to point *a* and also from point *e* to point O′ as illustrated in FIG. 7, the axis may spirally helically extend about the axis O*m* with progressively varying amounts of deviation. Although the axis extending from point *a* to point *e* in the illustration revolves exactly one turn about the axis O*m*, the amount of such turn is not so limited. To impart a satisfactory swirling force to the drain, at least about three-fourths turn is preferable, whereas more than 1.5 turns will lead to an increase in the size of the pipe portion. Thus, about $\frac{3}{4}$ turn to 1.5 turns are preferred.

The foregoing description is directed to the case wherein the branch fitting 3 having the twisted pipe portion 10 and branch portion is singly used to connect one lateral branch pipe to the vertical main pipe. However, when there are a plurality of lateral branch pipes 5 to be connected to the main pipe, another branch fitting 16 having a branch portion alone may be joined to an upper portion of the branch fitting 3 as illustrated in FIGS. 8 and 9. According to such arrangement, the number of the branches 14, 17, the vertical space between the branches 14, 17 and the orientation of the branches can be determined as desired by the combination of the kind and length of the branch fitting 16, the mode of connection between the branch fittings 3, 16, etc. This greatly facilitates the arrangement of branches for connecting lateral branch pipes in accordance with the arrangement of various fixtures 4 — a problem encountered with the single-pipe confluence system. If the branch fitting 3 is integrally formed with branches 14 for all lateral branch pipes in conformity with the arrangement of the fixtures, a wide variety of such branch fittings 3 will be needed, whereas the use of branch fittings in combination will minimize the kinds of branch fittings 3 of complex shape. Moreover, existing fittings are usable as the branch fittings 16. For example, when a predetermined distance *l* must be provided between the branch 14 for a soil water lateral branch pipe and a waste water lateral branch pipe as shown in FIG. 9, the desired arrangement can be provided by cutting off a suitable length of the lower end portion of the branch fitting 16.

Whereas the arrangement of FIGS. 8 and 9 includes the branch fitting 3 having a twisted pipe portion 10 and a branch portion integral therewith, a twisted fitting having a twisted pipe portion 10 along is usable in combination with branch fittings 16 joined to the upper end of the twisted fitting.

FIG. 10 is a view similar to FIG. 1 and showing another embodiment of the drainage piping system of this invention. Throughout these figures, like parts are referred to by like reference numerals. This embodiment includes branch fittings 16 and 18 having a branch portion or portions, and a separate twisted connector pipe 20 having a twisted pipe portion 10. The twisted connector pipe 20 is incorporated into the vertical main pipe 1 between the branch fittings 16, 18 on adjacent floors. As illustrated also in FIG. 16, the lowermost end of the vertical main pipe 1 is connected to a horizontal main pipe 6 by means of a twisted connector pipe 20 and a bend 19. In FIG. 11 showing the arrangement of the branch fittings 16, 18 and twisted connector pipe 20, conventional fittings are usable as the branch fittings 16, 18 which may be arranged in two stages, whereby the orientation, shape and spacing of the branches 17 for connecting lateral branch pipes can be determined as desired as is the case with the arrangement of FIG. 9. Since the twisted connector pipe 20 is not provided with any branch 17, the connector pipe has a reduced length and is compact, lightweight, simple in shape and therefore easy to make. Where there is a particular need to swirl the drain, the twisted connector pipes 20 may be arranged in two or three stages. Since the twisted connector pipe 20 can be disposed at a position other than where the vertical main pipe extends through the floor 2, the bore for passing the vertical main pipe through the floor can be of reduced size. The piping system is easy to install and the bored portion is easy to close and finish up, because the straight pipe passes through the bore.

The branches 14 and 17 of the branch fittings 3, 16 and 18 may have various shapes as shown in FIGS. 12*a* to 12*d*. Further with reference to FIGS. 13*a* to 13*e* showing some examples, the branch fittings can be variously modified in cross section with varying combinations of the number and orientation (whether tangential or radial) of the branches 14 and 17.

The structure of the connection between the vertical main pipe 1 and the horizontal main pipe 6, namely of the bend portion, will be described with reference to FIGS. 14 to 17. FIG. 14 shows the vertical main pipe 1 and horizontal main pipe 6 as connected together by a bend 7 formed with a twisted pipe portion in its upper half. As seen in FIG. 15, the bend 7 has a socket end 21 to be connected to the vertical main pipe 1 and an insert end 22 for connection to the horizontal main pipe 6. The twisted pipe portion 10 extends from the socket end 21 to a point *m* where the axis of the bend 7 intersects a phantom line extending from the center of curvature of the bend at an angle $\alpha$ with respect to a vertical phantom line extending from the center of curvature, the angle $\alpha$ being 45°. The twisted pipe portion has an axis O*t* helically deviating from the normal axis O*m* of the bend 7. From the point *m* to the insert end 22, the bend 7 has a progressively increasing diameter toward the end 22.

With this structure, the drain flowing down the inner surface of the vertical main pipe 1 in the form of a swirling stream as already described enters the socket end 21 and helically flows through the twisted pipe portion 10 of the bend 7 while swirling. From the point *m* toward the insert end 22, the drain flows with a reduced swirling motion. Because the drain is thus caused to swirl upstream of the 90° bend portion, the air column formed within the vertical main pipe 1 centrally thereof is allowed to gradually flow into an upper portion of the horizontal main pipe 6 without being blocked at the bend portion. This makes it possible to prevent an excessive rise in the positive pressure without employing a reverse vent pipe. Moreover, the swirling of the drain upstream of the horizontal main pipe 6 reduces the falling velocity of the fluid, eliminating the splash which otherwise would take place at the inlet of the horizontal main pipe 6. This also ensures prevention of the positive pressure increase. Furthermore, even if the lather of detergent remains within the horizontal main pipe 6, the drain comes into contact with the lather at a reduced speed, consequently suppressing the positive pressure buildup. The progessive increase in the diameter of the bend 7 toward its insert end enhances the effects described above.

In place of the bend 7 having the twisted pipe portion 10 integral therewith, an existing bend 19 may be usable in combination with the aforesaid twisted connector pipe 20 as illustrated in FIG. 16. Further as seen in FIG. 17, twisted connector pipes 20 may be arranged in two stages above the bend 19 to reduce the velocity of the drain flow for the prevention of splash and positive pressure increase and for the suppression of flow noise.

What is claimed is:

1. In a piping system for drainage including a vertical main pipe having at least one twisted portion therein for forming an air column extending centrally through the vertical main pipe, a horizontal main pipe, and a bend connecting the lowermost end of the vertical main pipe to the horizontal main pipe; the improvement wherein said bend is formed with a twisted upper portion having an axis deviating helically from a normal axis extending between the axes of said main pipes, and with a lower portion having a diameter which progressively increases toward the horizontal main pipe.

2. A bend type of piping member having joint portions at opposite ends thereof, one joint portion having a smaller diameter than the other joint portion, wherein the improvement comprises: a twisted portion extending from the joint portion of smaller diameter along part of the length of the bend, said twisted portion having an axis deviating helically from a normal axis extending between said joint portions, and a portion of progressively increasing diameter extending from the twisted portion along the remaining part of the length of the bend to the joint portion of larger diameter.

3. A bend type of piping member as set forth in claim 2 wherein that part of the length of the bend having said twisted portion therein extends throughout approximately one-half of the angular deviation between the ends of the bend.

4. A bend type of piping member as set forth in claim 3 wherein the length of that part of the bend having said twisted portion therein exceeds the length of the remaining part of the bend having said portion of progressively increasing diameter therein.

5. A bend type of piping member as set forth in claim 4 wherein said normal axis of the bend extends in a straight line from said joint portion of smaller diameter along part of the length of said twisted portion.

6. A bend type of piping member as set forth in claim 2 wherein a part of the angular deviation between the ends of the bend is provided by said twisted portion and the remaining part of the angular deviation is provided by said portion of progressively increasing diameter.

7. A bend type of piping member as set forth in claim 6 wherein the total angular deviation between the ends of the bend is provided in substantially equal parts by said twisted portion and by said portion of progressively increasing diameter.

* * * * *